US005862606A

United States Patent [19]

Jannach

[11] Patent Number: 5,862,606

[45] Date of Patent: Jan. 26, 1999

[54] DEVICE FOR DRYING, WASHING AND/OR DISINFECTING PROTECTIVE SUITS

[76] Inventor: Helmut Jannach, Andritzer Reichsstr. 66, A-8042 Graz, Austria

[21] Appl. No.: 817,327

[22] PCT Filed: Oct. 4, 1995

[86] PCT No.: PCT/AT95/00192

§ 371 Date: Jun. 30, 1997

§ 102(e) Date: Jun. 30, 1997

[87] PCT Pub. No.: WO96/10670

PCT Pub. Date: Apr. 11, 1996

[30] Foreign Application Priority Data

Oct. 4, 1994 [AT] Austria ..... GM 330/94
Mar. 2, 1995 [AT] Austria ..... GM 112/95

[51] Int. Cl.[6] ..... F26B 25/00

[52] U.S. Cl. ..... 34/106; 134/166 R; 223/70

[58] Field of Search ..... 34/104, 106, 107; 134/22.1, 62, 115 R, 166 R, 201; 223/67, 70

[56] References Cited

U.S. PATENT DOCUMENTS

| | | | |
|---|---|---|---|
| 2,883,092 | 4/1959 | McMillan | 34/104 |
| 4,727,656 | 3/1988 | Jannach et al. | 34/104 |
| 4,967,060 | 10/1990 | Lomeli | 34/104 X |
| 4,989,624 | 2/1991 | Darling | 134/100 |
| 5,037,487 | 8/1991 | Santos | 134/22.1 |
| 5,412,928 | 5/1995 | Reithel | 34/104 |
| 5,592,750 | 1/1997 | Eichten | 34/104 |
| 5,692,316 | 12/1997 | Antal | 34/106 |

FOREIGN PATENT DOCUMENTS

| | | |
|---|---|---|
| 0 468 212 | 1/1992 | European Pat. Off. . |
| 39 12 835 | 12/1989 | Germany . |
| 600 851 | 6/1978 | Switzerland . |
| 679 164 | 12/1991 | Switzerland . |

OTHER PUBLICATIONS dictionalry definition of "hoop", Webster's II New reiverside University Dictionary, 1994.

*Primary Examiner*—Henry A. Bennett
*Assistant Examiner*—Steve Gravini
*Attorney, Agent, or Firm*—Foley & Lardner

[57] ABSTRACT

The invention relates to a device for drying protective suits, for which the suit is put over a supporting framework, which consists of tubes and reaches into all extremities of the suit, the tubes having outlet openings at their ends for warm air that has been blown in. The supporting framework 1; 101 is formed by tubular hoops 2, 3, 4, 5; 102, 103, 104, 105; 102', 103', 104', 105' which, in the area of the feet and hands of the protective suit, have bends 6, 7, 8, 9; 106, 107, 108, 109; 106', 107', 108', 109', in which the outlet openings 21; 121 for the drying air are disposed. An additional connecting piece 124; 124', which optionally can be shut off, is provided at the common manifold 18, 118, 118' for supplying detergents and disinfectants, it being possible preferably to shut off the drying air line before the connecting piece 124 also by means of a valve 125.

6 Claims, 4 Drawing Sheets

DEVICE FOR DRYING, WASHING AND/OR DISINFECTING PROTECTIVE SUITS

Figure 1:
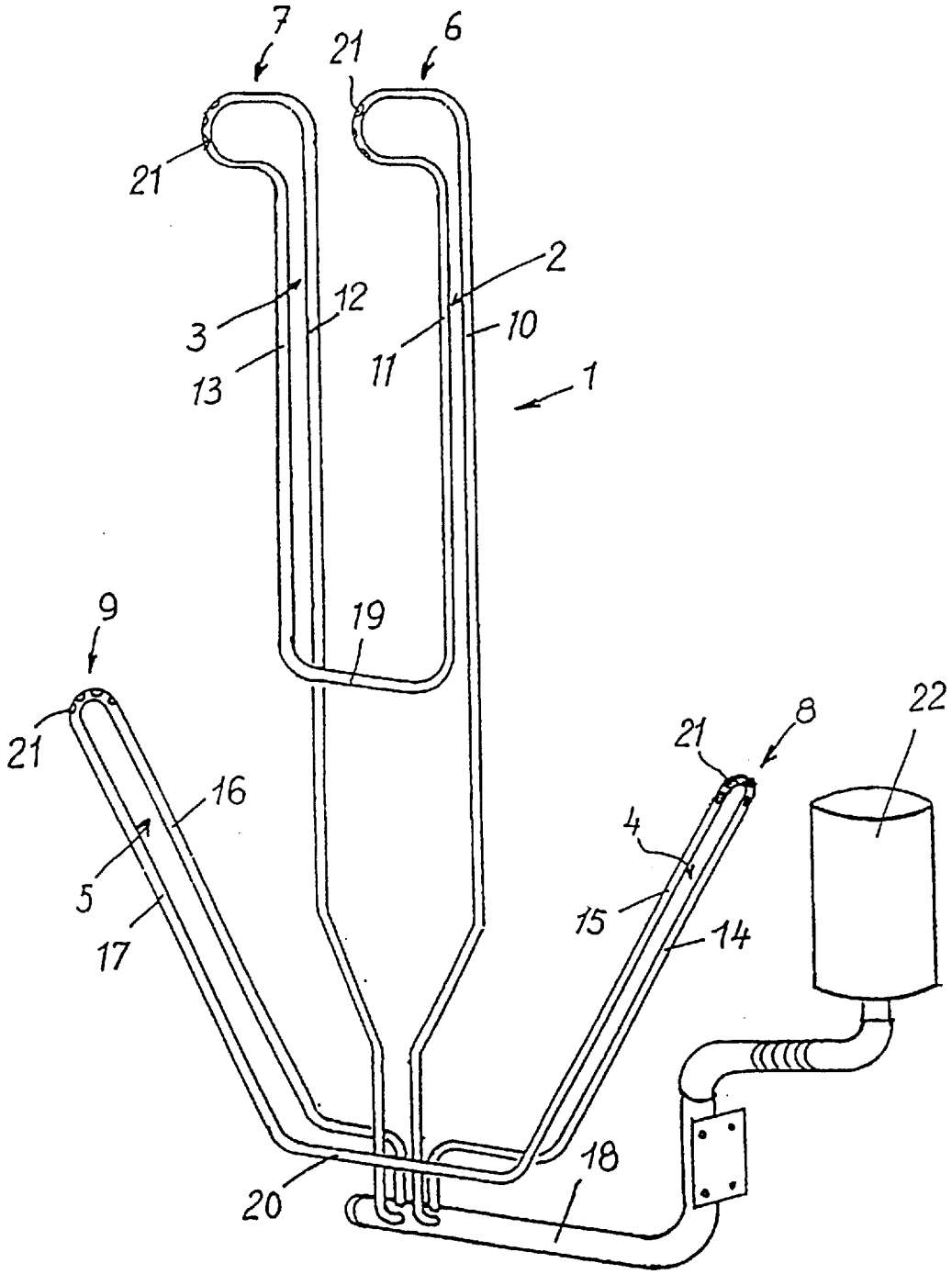

The invention relates to a device for drying protective suits, for which the suit is put over a supporting framework, which consists of tubes and reaches into all extremities of the protective suit, the tubes having outlet openings at their ends for warm air that has been blown in.

In the case of an embodiment of this type, known from the EP 0468212, a supporting framework is provided, which can be assembled from several lengths of tube. Starting out from a central tube and extending over lateral connecting pieces, lengths of tube extend into the arms and legs of the protective suit. At their free ends, these lengths of tube are open, so that warm air, blown into the tubes, emerges at these ends and passes through the protective suit. This embodiment has the disadvantage that, particularly in the region of the feet, the inside of the protective suit lies against the openings, so that only a limited amount of drying air can emerge particularly there, since the boot insoles act like a butterfly valve and close off these outlet openings. The bulk of the air will then enter through the arms into the protective suit, as a result of which the foot and leg regions of the protective suit are not dried or not dried adequately. In addition, because of the large air outlet opening in the region of the arms and the hands, it is not possible to control the amounts of air in such a manner, that the required amount of drying air is also brought into the foot region of the protective suit.

The DE 3912835 A1 discloses a device for drying protective suits, for which the protective suit is suspended by the heels on a frame-like support. A manifold device for the drying air, assembled from individual tube sections, is introduced into the interior of the protective suit and, over bent end regions of the pipe sections inserted into the legs of the protective suit, suspended in the foot parts of the boots of the protective suit. The impacting of the manifold device is accomplished over an air hose, introduced into the protective suit through the entry opening.

It is an object of the invention to provide a device of the type mentioned above, with which uniform drying of the whole of the protective suit becomes possible.

Pursuant to the invention, this objective is accomplished owing to the fact that the supporting framework is formed by tubular hoops which, in the region of the feet and hands of the protective suit, have bends, in the bends of which the outlet openings for the drying air are disposed. Because of this construction, the leg and arm regions of the protective suit are held open in such a manner and, with that, the outlet openings are kept free, so that a proper drying effect occurs at all times. For protective suits, it is important that the tubular hoops hold the protective suits in such a manner, that bends, etc. are avoided in order to make an appropriate flow of drying air possible and to prevent a closing of the air outlets.

Advantageously, the outlet openings for the drying air can be directed in the curves of the bends towards the foot or finger tips of the protective suits, as a result of which it is ensured that the protective suit, put over the tubular hoops, is dried properly in all regions. Finally, the tubular hoops, in the region of the legs or arms, can have shanks, which run parallel to one another and are at a distance from one another, a shank of the hoops starting out in each case from a common manifold and the other shanks of similar hoops being connected in a conducting manner with one another. The hoops, protruding into the legs, are thus combined with one another into one piece, as are the hoops protruding into the arms, so that, on the one hand, very stable carrying frameworks are achieved and, on the other, the drying air can be blown out well, since drying air is blown in through both ends and prevented from flowing back.

For a further, advantageous embodiment, with which the protective suit can also be washed and disinfected, an additional connecting piece, which can optionally be closed off and is intended for supplying a detergent and/or a disinfectant, can be provided at the common manifold. Preferably, the pipeline for the drying air can also optionally be closed off before the connecting piece. With that, either only washing liquor, disinfecting liquor, etc. alone or drying air alone or both together can be introduced, by means of which the inside of the suit can be washed and dried. After the two closing valves are switched over, the blower can be switched on and drying air can be passed through the same framework into the protective suit.

Furthermore, the outlet openings can also be used for introducing the detergent and/or the disinfectant. By these means, it is achieved that the detergent and/or the disinfectant reaches into the very outermost tips of the extremities, so that appropriate cleaning and disinfecting also takes place there. Finally, further outlet openings, directed into the interior of the headgear of the protective suit, can be provided at the common manifold or at the outlet regions of the tubular hoops of the supporting frame. On the one hand, these outlet openings serve for washing, disinfecting and drying the protective suit and, moreover, of the hood, which is to be pulled over the head. On the other, when the supply of detergent and/or disinfectant is switched off, they enable these materials in the tube to flow out without flowing into the blower after the valve, which is provided in the drying-air line, is opened.

Examples of the object of the invention are given in the drawings, in which

Figure 2:
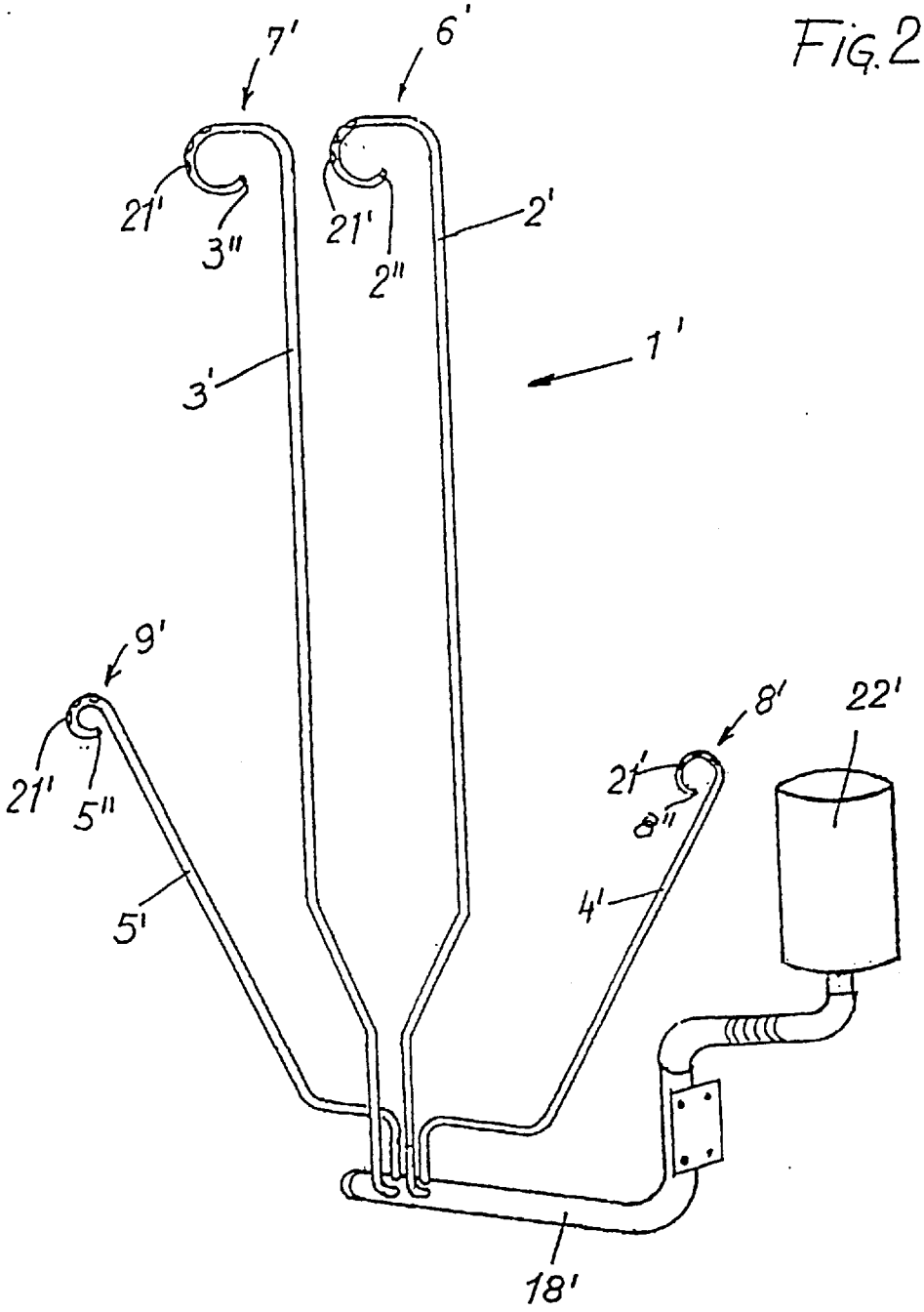
Figure 3:
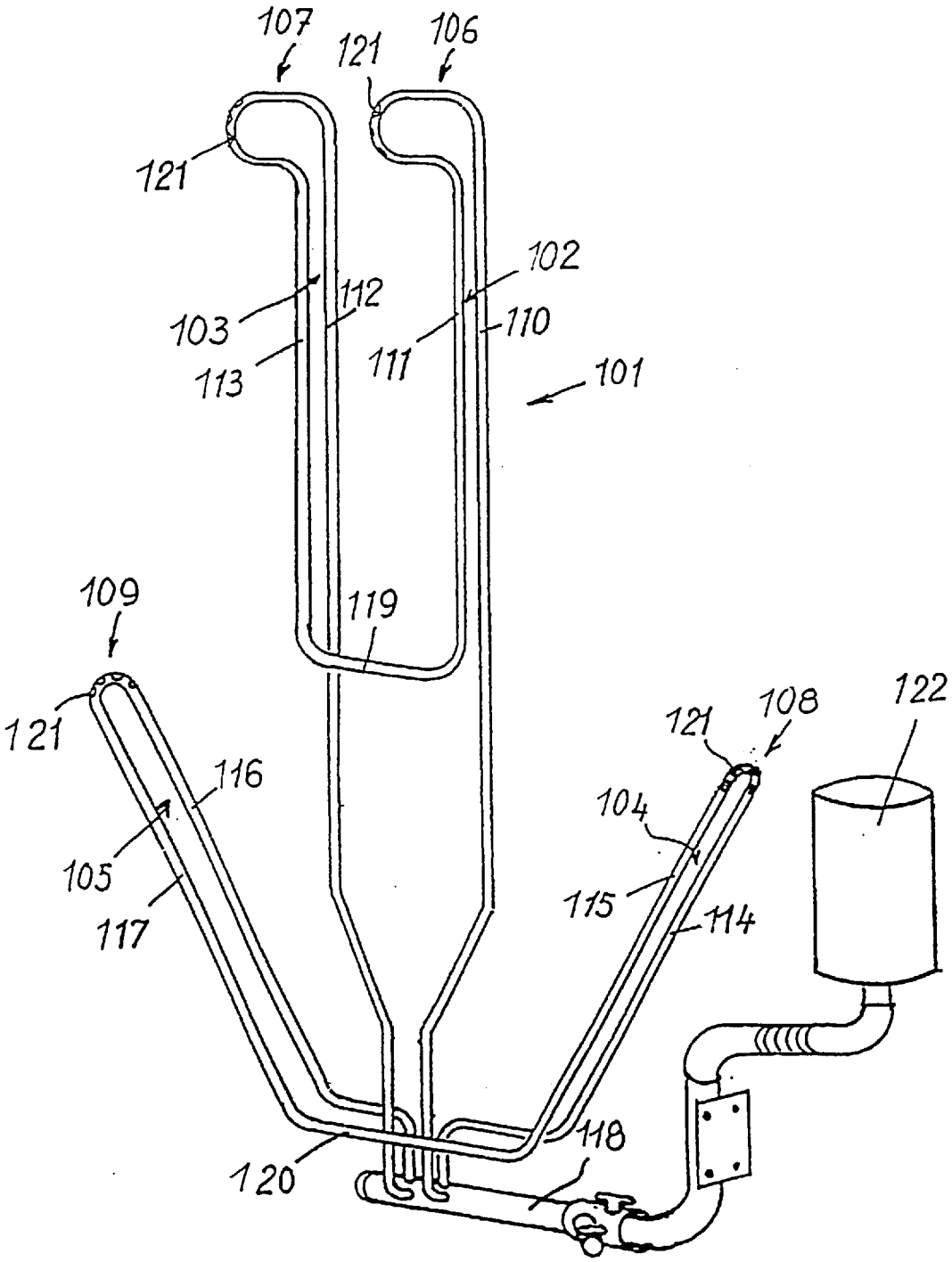

FIG. 1 diagrammatically shows a first variation of an embodiment,

FIG. 2 also diagrammatically reproduces a second variation,

FIG. 3 diagrammatically shows a third variation of an embodiment and

Figure 4:
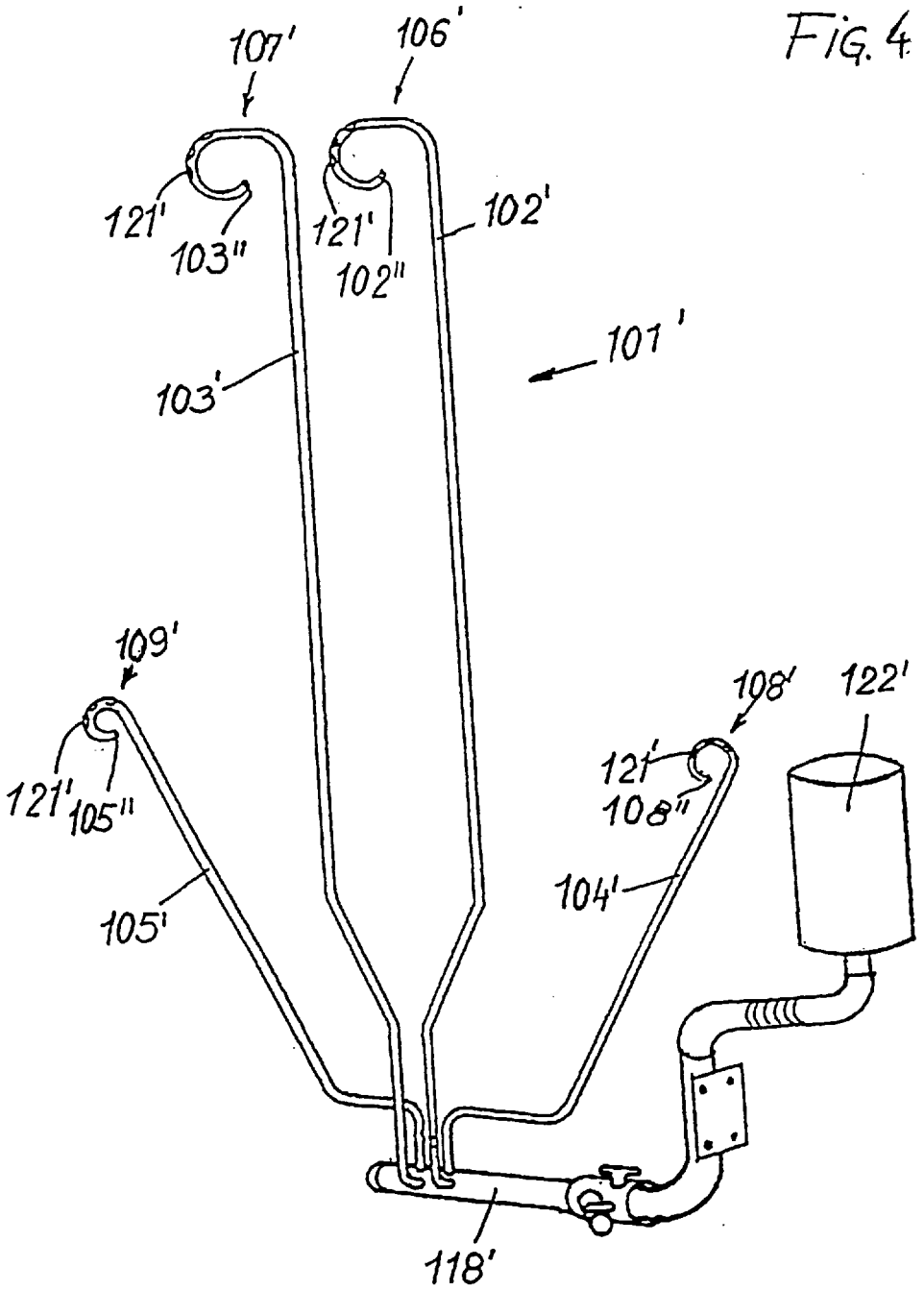

FIG. 4 also diagrammatically reproduces a fourth variation.

For the example of FIG. 1, a supporting framework 1 is formed by tubular hoops 2, 3, 4 and 5. The tubular hoops 2, 3 are provided for introduction into the leg regions and the tubular hoops 4, 5 for introduction into the arm regions of the protective suit, which is to be dried. At their ends, the tubular hoops have bends 6, 7, 8, 9, which combine shanks 10, 11 and 12, 13 and 14, 15, and 16, 17 with one another. These shanks run parallel to one another and are spaced at such a distance from one another that, on the one hand, the introduction into the protective suit can proceed without any difficulties and, on the other, the walls of the protective suits are prevented from lying against one another, thus permitting the passage of drying air.

In each case, one shank of the hoops starts out from a common manifold 18. In the present case, these are the shanks 10, 12, 14 and 16, the other shanks, in the present case the shanks 11, 13 and 15, 17 of, in each case, similar hoops 2, 3 and 4, 5, being connected to one another over tube sections 19, 20. Warm air is thus blown from both sides into all of the tubular hoops, so that the whole of the warm air blown in can emerge over air outlet openings 21, provided at the bends 6, 7, 8, 9 into the protective suit that is to be dried. The air outlet openings 21 are disposed in such a matter in the bends 6, 7, 8, 9, that they are directed towards the tips of the feet and the fingers, in order to achieve in this manner a selective drying also of these extreme regions.

The manifold 18 is acted upon with drying air by means of a blower 22, which is designed so that it blows warm air, the temperature of which does not exceed certain limits, into the manifold and introduces it by way of the air outlet openings 21 into the protective suit.

The example of FIG. 2 shows a different variation, which is suitable particularly for lighter suits. The tubular hoops 2', 3', 4' and 5', forming the supporting framework 1', have closed ends 2", 3", 4" and 5", which are disposed at the ends of the bends 6', 7', 8' and 9'. The air outlet openings 21' are disposed at the appropriate positions of the bends 6', 7', 8' and 9'. The tubular hoops 2', 3', 4' and 5' start out individually from the manifold 18', which is acted upon with drying air from the blower 22'.

In the example of FIG. 3, a supporting framework 101 is formed by tubular hoops 102, 103, 104 and 105. The tubular hoops 102, 103 are intended for introduction into the leg areas and the tubular hoops 104, 105 are intended for introduction into the arm areas of the protective suit, which is to be dried. At their ends, the tubular hoops have bends 106, 107, 108, 109, which connect the shanks 110, 111 and 112, 113 and 114, 115 and 116, 117 with one another. These shanks run parallel to one another and are spaced at such a distance from one another that, on the one hand, the introduction into the protective suit can take place without difficulties and, on the other, the walls of the protective suits are prevented from lying against one another, thus permitting the passage of drying air.

In each case, one shank of the hoops starts out from a common manifold 18. In the present case, these are the shanks 110, 112, 114 and 116, the other shanks, in the present case the shanks 111, 113 and 115, 117 of, in each case, similar hoops 102, 103 and 104, 105 being connected to one another over tube sections 119, 120. Warm air is thus blown from both sides into all of the tubular hoops, so that the whole of the warm air blown in can emerge over air outlet openings 121, provided at the bends 106, 107, 108, 109, into the protective suit, which is to be dried. The air outlet openings 121 are disposed in such a matter in the bends 106, 107, 108, 109, that they are directed towards the tips of the feet and the fingers, in order to achieve in this manner a selective drying also of these extreme regions.

The manifold 118 is acted upon with drying air by means of a blower 122, which is designed so that it blows warm air, the temperature of which does not exceed certain limits, into the manifold and introduces it by way of the air outlet openings 21 into the protective suit.

The example of FIG. 4 shows a different variation, which is suitable particularly for lighter suits. The tubular hoops 102', 103', 104' and 105', forming the supporting framework 111', have closed ends 102", 103", 104" and 105", which are disposed at the ends of the bends 106', 107', 108' and 109'. The air outlet openings 121' are disposed at the appropriate positions of the bends 106', 107', 108' and 109'. The tubular hoops 102', 103', 104' and 105' start out individually from the manifold 118', which is acted upon with drying air from the blower 122'.

In both variations, a branch 123, 123' is provided in the manifold 118, 118'. Through this branch 123, 123', either a disinfecting liquid and/or a washing liquid or a different medium is introduced over valve 124, 124' or air is supplied over valve 125, 125'. Of course, both valves can also be open, for example, when a gaseous disinfectant is introduced over valve 124, 124'.

In the regions of the branches for the supporting tubes, the manifold 118 and 118' has downwardly directed outlet openings 126, 126', which are intended to introduce drying air or disinfectant and/or detergent into the interior of the hoods of the protective suit. At the end of the introduction phase over the connecting pieces 124, 124', the detergent and/or the disinfectant in the tubes can then also be ejected through these openings, so that washing liquid and/or disinfecting liquid is/are prevented from flowing back out of the tubes into the blower 122, 122'.

I claim:

1. A device for drying protective suits, for which the suit is put over a supporting framework, which consists of tubes and reaches into all extremities of the suit, the tubes having outlet openings at their ends for warm air that has been blown in, characterized in that the supporting framework (1; 1') is formed by tubular hoops (2, 3, 4, 5; 2', 3', 4', 5') which, in the area of the feet and hands of the protective suit, have bends (6, 7, 8, 9; 6', 7', 8', 9'), in the curves of which the outlet openings (21; 21') for the drying air are disposed.

2. The device of claim 1, characterized in that the outlet openings (21; 21') for the drying air in the curves of the bends are directed to the tips of the feet and the fingers of the protective suit.

3. The device of claim 1, characterized in that the individual tubular hoops (2, 3, 4, 5) run parallel to one another in the region of the legs and the arms, have shanks (10, 11, 12, 13, 14, 15, 16, 17), which are at a distance from one another, a shank (14, 16; 10, 12) of the hoops (2, 3, 4, 5) starting out in each case from a common manifold (18) and the other shanks (18, 17, 11, 13) of similar hoops (4, 5; 2, 3) being connected to one another in a conducting manner with one another.

4. The device of claim 1, characterized in that an additional connecting piece (124; 124'), which optionally can be shut off, is provided at the common manifold (118; 118') for supplying detergent and disinfectant, it being possible preferably to shut off the drying air line before the connecting piece (124; 124') also by means of a valve (125; 125').

5. The device of claim 4, characterized in that the outlet openings (121; 121') can also be used to introduce detergents and/or disinfectants.

6. The device of claim 1, characterized in that further outlet openings (126; 126'), directed into the interior of headgear, are provided at the common manifold (118, 118') and at the outlet regions of the tubular hoops (102, 103, 104, 105; 102', 103', 104', 105') of the supporting framework (101; 101').

* * * * *